United States Patent [19]

Coale

[11] 4,000,909

[45] Jan. 4, 1977

[54] SKI BOOT SNOW SCRAPER

[76] Inventor: Sidney C. Coale, 4305 Bluebird, Union Lake, Mich. 48085

[22] Filed: June 20, 1975

[21] Appl. No.: 588,871

[52] U.S. Cl. ..... 280/11.37 E; 15/237

[51] Int. Cl.[2] ..... A63C 11/18

[58] Field of Search ..... 280/11.37 E; 15/237

[56] References Cited

UNITED STATES PATENTS 3,929,345 12/1975 Nasby et al. ..... 280/11.37 E

FOREIGN PATENTS OR APPLICATIONS 1,285,357 1/1962 France ..... 280/11.37 E 78,501 4/1951 Norway ..... 280/11.37 E 37,247 6/1923 Norway ..... 280/11.37 E 69,611 10/1945 Norway ..... 280/11.37 E

*Primary Examiner*—Joseph F. Peters

*Assistant Examiner*—Milton L. Smith

*Attorney, Agent, or Firm*—Russel C. Wells

[57] ABSTRACT

A ski boot snow scraper is attached to one of a skier's ski poles and is readily available to remove the caked snow from the bottom of a ski boot so that the ski boot can be properly and safely placed and clamped within the bindings of the ski.

1 Claim, 8 Drawing Figures

SKI BOOT SNOW SCRAPER

FIELD OF INVENTION

The invention herein relates to ski equipment in general and more particularly to a device to assist removal of snow from the ski boot.

SUMMARY OF INVENTION

Many skiers have found that while walking to the top of the hill or to the place where they must or can put on their skis, snow has caked in the soles of their ski boots. This snow must be removed so that their boot will fit securely in the binding on their ski. This caked snow must be removed by a digging or scraping operation and cannot generally be removed by tapping the boot against a rigid structure. This scraping though annoying and tedious must be completed before the boot can be clamped into the binding.

It is a principle object of this invention to provide a ski boot snow scraper that may be rigidly attached to the ski pole and thereby always present so as to be effectly used to clean the caked snow from a skier's boot.

It is another object of this invention to provide a unitary ski boot snow scraper member adapted to be taped to a ski pole.

In accordance with these and other objects of the invention, there is described and claimed herein a ski boot snow scraper for attaching to a ski pole. The scraper has an elongated blade member portion which extends a short distance away from the ski pole. The extent of said blade member is sufficient enough to effectively remove the caked snow from a boot but yet will not interfere with the normal operation of a ski pole by the skier.

The blade member is secured to an elongated attaching member which has a circular shape so as to conform to and overlap the ski pole. The attaching member extends on either side of the blade member to form a pair of securing ends. A pair of strap members secure the attaching member to the ski pole. In the preferred embodiment, the blade member and the attaching member form an integral unit.

DETAILED DESCRIPTION

Figure 1:
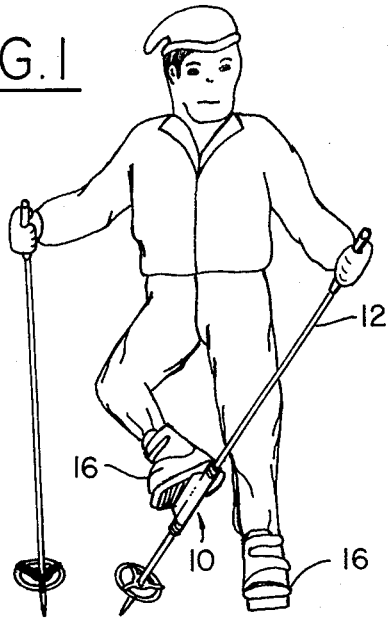
FIG. 1 is a drawing of a skier using the scraper herein.

Referring to the Figures by the characters of reference, there is illustrated in FIG. 1 a view of a skier utilizing the ski boot snow scraper 10 of the preferred embodiment. The scraper 10 is attached to one of the ski poles 12 by means of a pair of straps 14 and 15.

Figure 2:
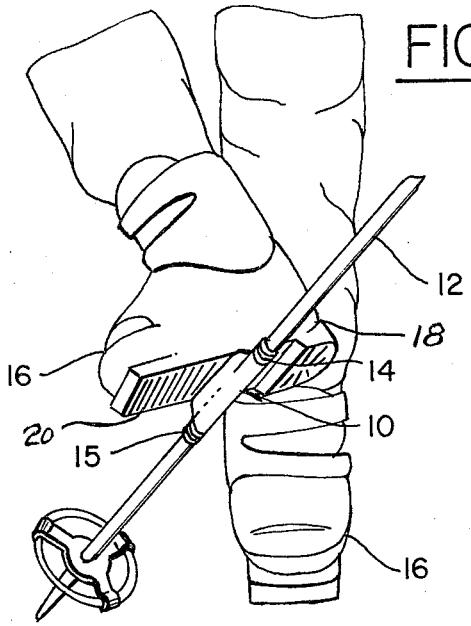
FIG. 2 is an enlarged view of a portion of FIG. 1.

As illustrated in FIG. 2, the bottom, ends and sides of a skier's boot 16 have several forms 18, ribs 20 and other areas capable of receiving and retaining snow. The snow, which is caked and retained, does not allow the skier to place his boot correctly and securely into his bindings on the ski.

Referring to FIG. 2 there is illustrated in an enlarged view the action of the scraper 10 removing snow from the ribs 20 of the ski boot 16. In the preferred embodiment, the scraper 10 is a unitary, integral structure.

Figure 3:
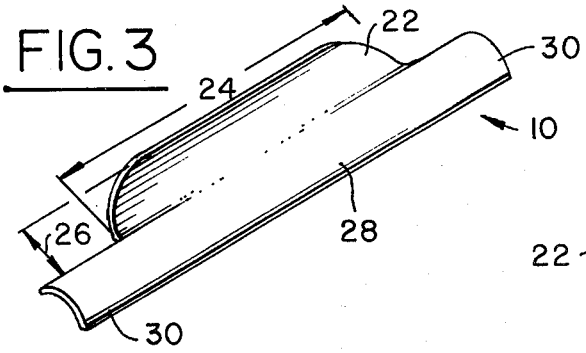
FIG. 3 is a perspective view of a preferred embodiment of the scraper.

In FIG. 3, a perspective view of the scraper 10 illustrates a blade means 22 with a length 24 substantially longer than its width 26. The ends of the blade means 22 may be rounded or form a sharp corner. The blade means 22 is a rigid member having the capability to withstand the pressures of snow removal.

Figure 4:
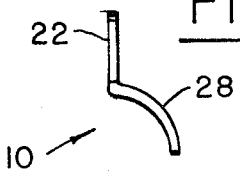
FIG. 4 is an end view of the embodiment of FIG. 3.
Figure 7:
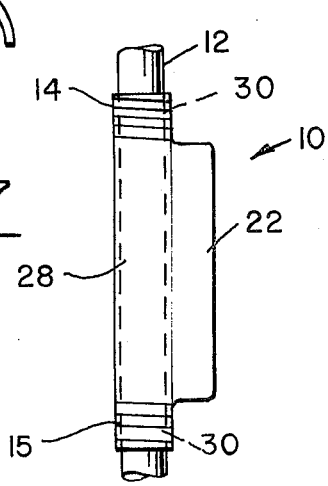
FIG. 7 is an illustration of the preferred embodiment secured to a ski pole.

The blade means 22 is secured along its length 24 to an attaching means 28. In FIGS. 3, 4, and 7, the attaching means 28 is typically an arcuate member of 90°. The blade means 22 extends substantially normal to one of the elongated sides of the attaching means as clearly shown in FIG. 4.

The attaching means 28 has an elongated length longer than the blade means 22 and extends on each side of the blade means 22 forming a pair of securing ends 30. Each securing end 30 cooperates with a strap member 14 and 15 to secure the scraper 10 to the ski pole 12 between the handle and the snow basket of the pole as illustrated in FIGS 1 and 2. The strap member 14 and 15 may be lengths of a tape as illustrated or any similar strap adapted to hold the scraper 10 to the ski pole 12 without adding any appreciable weight or providing any wind drag.

Figure 5:
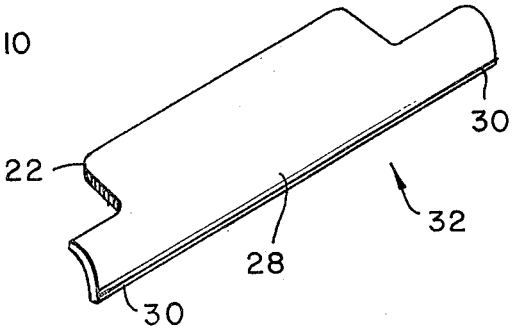
FIG. 5 is a perspective view of another embodiment of the scraper.
Figure 6:
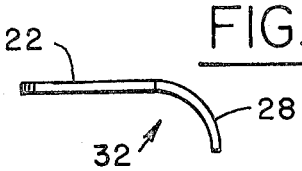
FIG. 6 is an end view of the embodiment of FIG. 5.
Figure 8:
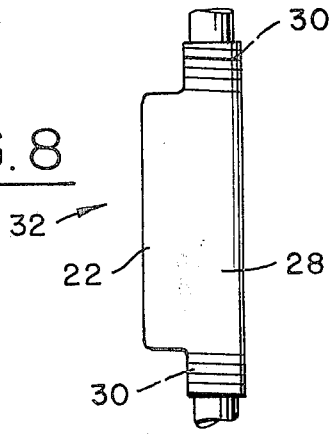
FIG. 8 is an illustration of the embodiment of FIG. 5 secured to a ski pole.

FIGS. 5, 6 and 8 illustrate a modification scraper 32 wherein the blade means 22 is an elongated member extending tangentially and contiguously to the attaching means 28. This modification requires one less forming operation and may provide a stronger unitary scraper 32. However, this modification may provide a pocket between the blade means and the pole where snow might accumulate.

A still further modification, which is not illustrated would include an attaching means having a circular shaped member of greater than 90°. Such an attaching means may enclose or substantially overlap the ski pole 12. However in all instances at least one form of strap means is necessary to secure the scraper to the pole.

Within the concept of the invention herein, a ski pole 12 may be modified to provide a rib extending along its length for any distance. This rib will be the blade means of the scraper herein and the attaching means will be integral with the ski pole 12. The blade means may be spot welded to the pole during manufacture.

There has thus been illustrated and described a ski boot scraper either attached to or integral with a ski pole for allowing a skier to remove caked and hard snow from the forms and ribs of his ski boots prior to placing and clamping his boot into a binding on a ski.

What is claimed is:

1. A ski boot snow scraper for attaching to a ski pole, said scraper comprising:

blade means having a length substantially longer than its width, said blade means being a rigid member, attaching means integrally formed with said blade means for attaching said blade means to the ski pole near one end thereof and between the handle and the snow basket on the ski pole, said attaching means having an arcuate form for conforming to and overlapping the pole and having a length longer than said blade means and said blade means is positioned intermediate the ends of said attaching means forming securing ends at each end of said attaching means, said securing ends receiving a pair of strap members respectively placed on said securing ends, and circling the ski pole and securing said scraper idly thereto.

* * * * *